United States Patent [19]

Piazza

[11] 4,021,068

[45] May 3, 1977

[54] GOLF BALL RETRIEVERS

[76] Inventor: Anthony F. Piazza, 1408 Valecroft Ave., Thousand Oaks, Calif. 91361

[22] Filed: Feb. 23, 1976

[21] Appl. No.: 660,481

[52] U.S. Cl. ..... 294/19 A; 267/64 R
[51] Int. Cl.[2] ..... B66C 1/02
[58] Field of Search ..... 294/19 A, 19 R, 1 R, 294/20, 21, 50.6, 50.7, 50.8, 50.9, 55, 64 R, 64 A, 64 B, 99 R, 110 R, 110 A; 273/32 R, 32 B, 32 D, 32 F, 162 E; 56/328 R, 332

[56] References Cited

UNITED STATES PATENTS

| | | | |
|---|---|---|---|
| 1,024,286 | 4/1912 | Santilli | 294/64 R |
| 2,573,002 | 10/1951 | Foster | 294/64 R |
| 2,760,807 | 8/1956 | Watson | 294/19 A |
| 2,968,508 | 1/1961 | Borah | 294/19 A |

*Primary Examiner*—James B. Marbert

[57] ABSTRACT

This invention relates to a device for retrieving golf balls comprising in combination a tapered receptacle and a vacuum pump whereby a golf ball can be forced into and retained by the receptacle by direct pressure or by the use of vacuum and can be released by operation of the vacuum pump lever.

2 Claims, 3 Drawing Figures

GOLF BALL RETRIEVERS

Devices previously designed for the retrieval of golf balls have employed some form of receptacle into which the ball is wedged or otherwise trapped. An extended handle fixed to the receptacle permits it to be placed over or around the ball. A frequent application of these retrievers is to recover balls from more or less inaccessible areas such as the bottom of a water hazard, ravine or deep brush. In a number of these situations it is difficult to trap the ball inside the receptacle with existing equipment because pressure must initially be exerted in a direction away from the user. In the case of a ball resting on the soft silt of a water hazard for example such pressure may only serve to bury the ball deeper into the bottom. A similar situation would exist in soft underbrush and on sand. To overcome this disadvantage of the head-on type of retriever some devices employ a side scoop arrangement. The latter, while generally effective are not suitable for head-on recovery such as would be necessary when retrieving the ball from a putting green cup.

It is one purpose of this invention to provide improvements in golf ball retrievers which will permit easy ball recovery from a wide range of situations. It is another object of this invention to create forces which attract the ball to the retriever so that the user does not need to push in a direction away from himself inorder to trap the ball. It is yet another object of the invention to permit use of the push-away recovery technique when this is advantageous as for example when the ball is resting on hard terrain.

Briefly the invention comprises a tapered receptacle to which a hand operated vacuum pump is attached. The receptacle is sized so that a golf ball entering its lower end will be lightly trapped against its flexible sides. The vacuum pump is part of the retriever handle and is preferably of the piston and cylinder type. Other arrangements for creating a partial vacuum can however be adapted without changing the principle of the invention. When the retriever is used for a ball lying on a soft surface, the receptacle is moved over the ball and in close proximity to it. A movement of the vacuum pump piston creates a flow of air or water as the case may be towards and around the ball. The force of the flow pushes the ball into the receptacle where it is trapped. The retriever can now be withdrawn from the water hazard or rough. A reverse motion of the piston then frees the ball. When used with balls lying on hard terrain, the invention is lowered over the ball and pushed in a direction away from the user. This forces the ball into the receptacle and no use is made in this case of the vacuum pump.

It is a still further object of the invention to provide means for removal of the ball from the retriever without direct handling so that the hands do not come in contact with any water, vegetation or sand which may be retained by the ball. Other objectives and advantages of the invention will become apparent from the following description and the accompanying drawings.

The invention is shown on the following drawings wherein.

Figure 1:
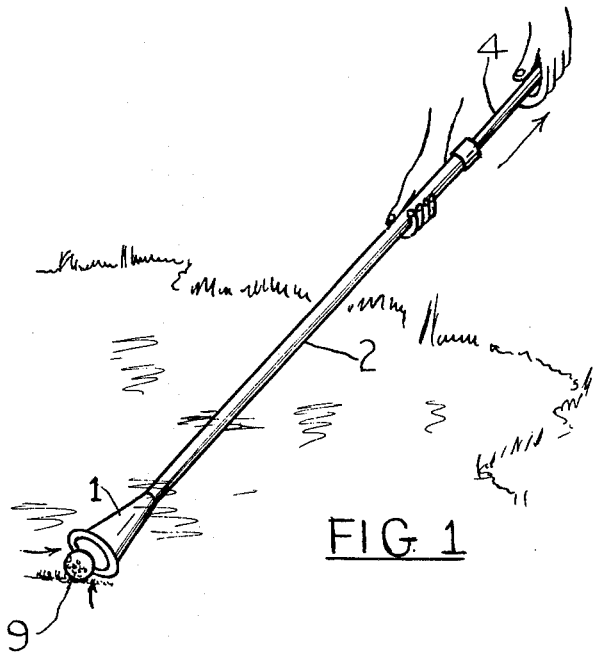
FIG. 1 is a perspective view showing the invention being used to recover a ball from a water hazard.
Figure 2:
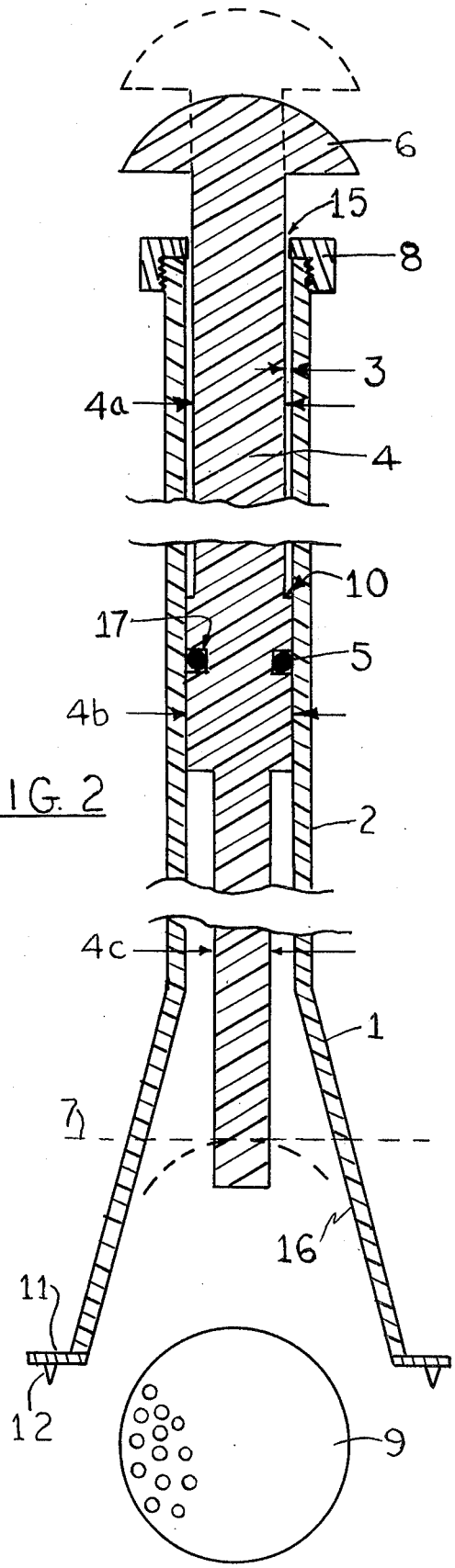
FIG. 2 is a cross sectional view indicating the inner structure of one form of the invention.

Referring now in detail to FIGS. 1 and 2 it will be seen that the invention is comprised of a tapered receptacle 1 firmly and communicably joined to a tubular handle 2. The receptacle is preferably in the form of a truncated cone and made of relatively thin material so that its walls are somewhat flexible. A ball 9 entering the receptacle 1 flexes the walls slightly and is locked inside the receptacle by friction. Plastic has been found suitable as a material of construction for the receptacle but other materials such as aluminum can be used. The inner surface 16 of the receptacle 1 is roughened to aid in frictional retention of the ball. The piston 4 in FIG. 2 is comprised of three sections of differing lengths and diameters. The relatively long upper section 4*a* is of a diameter somewhat less than the inside of tubular handle 2. The relatively short center section 4*b* is of a diameter to give a close fit with the inside of the tubular handle 2 and contains an annular groove 17 and an O ring 5. The center section by its construction acts as a moving seal and is used to create a partial vacuum in receptacle 1. The lower section 4*c* of the piston is relatively long and of the smallest diameter. The lower section of the piston serves several purposes. During a retrieval from a hard surface the lower section is contacted by the ball and is moved upwards to the position 7 shown in FIG. 2. An operating knob 6 joined to the upper section of the piston moves and signals the user that the ball has entered the receptacle. Downward pressure on knob 6 now frees the ball.

When the invention is employed to retrieve a ball from water as is shown in FIG. 1, the operation is somewhat different. The receptacle 1 is moved within a short distance of the ball. The operating knob 6 is now pulled back with one hand while the handle 2 is held with the other. The partial vacuum thus created in receptacle 1 induces a rapid flow of water towards its opening. The ball 9 is thereby forced into receptacle 1 and is frictionally retained. The seal between the ball 9 and the walls of the receptacle is not completely tight because of the roughened surface 16 and the dimples in the surface of the ball so that the vacuum is soon relieved after the ball is in place. The frictional retention of the ball against surface 16 is however not altered by the relief of the partial vacuum. Whenever the user desires to release the ball, he presses the operating knob 6 downward. The sealing section 4*b* of the piston 4 acting against the air in the inside of handle 2 now functions as a pressure pump and forces the ball to drop out of the receptacle 1.

A cap 8 threadably fitted to the handle 2 and cooperating with the shoulder 10 prevents the piston 4 from being withdrawn entirely from the handle. A clearance 15 is provided between cap 8 and piston 4 so that no pressure or vacuum effects occur in the annular space 3 on the upper side of the sealing section 4*b*.

A lip 11 and studs 12 permit the user to keep the invention in an upright position and on standby when it is being frequently used such as would be the case on a putting green. The invention can be stored and carried in a conventional golf bag.

Figure 3:
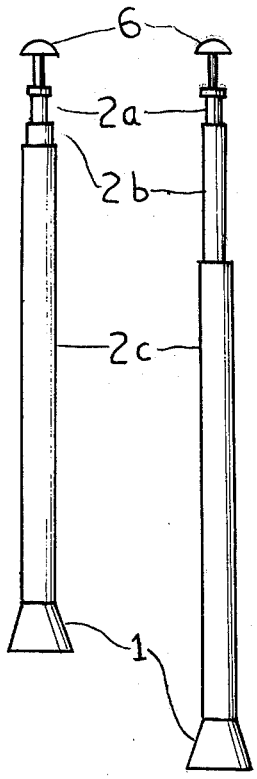
FIG. 3 is a pair of views of a modification of the invention.

FIG. 3 illustrates a modified form of the invention. The tubular handle 2 of the previously described form shown in FIGS. 1 and 2 is now replaced by a telescoping handle having 3 tubular segments 2*a*, 2*b* and 2*c* shown in FIG. 3. The tubular segment 2*a* slidably retracts into the tubular segment 2*b* and segment 2*b* slidably retracts into tubular segment 2*c*. The receptacle 1 is joined to tubular segment 2*c* in this form of the invention. It will be apparent that it is now possible to adjust the length of the retriever by use of the telescoping sections and to thus adapt the invention for use under varying circumstances of distance of the ball from the user. Three telescoping sections are used for illustration of the principle; any number of sections can be employed. The telescoping sections can be made to frictionally retain their position where set or can be provided with tightenable collets at each junction as is known in the art.

In the above discussion several versions of the invention have been detailed but it will be apparent that other embodiments and variations in details of construction can be made without departing from the spirit of the invention or the scope of the subjoined claims. Furthermore the application of the invention is not restricted to golf ball retreiving but it can be used to retrieve other objects as well.

I claim:

1. In a golf ball retriever containing a vacuum producing means connected by a passage to a receptacle which is of a size, shape and inner texture to accept and releasably retain a golf ball said vacuum producing means serving also as a pressurizing system for freeing a retained golf ball at the convenience of the user and said vacuum producing means being comprised of a tubular handle and a close fitting piston joined to an elongated and slidable rod which is terminated in its upper section in a knob for grasping, an improvement comprising a lower rod section extending from said piston whereby entry of a golf ball into said receptacle induced by the lowering of the receptacle over the ball causes upward sliding of the piston, produces visible movement of said knob and provides a signal of the golf ball's presence in the receptacle, said lower rod section serving also as a second means for releasing the golf ball when said knob is pushed downwards with respect to the tubular handle.

2. A golf ball retriever as set forth in claim 1 wherein said tubular handle is surrounded by a series of successively larger, tubular, telescopically arranged and frictionally engaged handle elements the largest of which is attached to said receptacle whereby the effective operating length of the retriever can be adjusted as desired by the user.

* * * * *